United States Patent [19]

Stark

[11] 3,935,599

[45] Feb. 3, 1976

[54] MOVABLE SWIMMING POOL BULKHEAD

[76] Inventor: Robert Stark, 735 NE. 198th, Seattle, Wash. 98155

[22] Filed: July 31, 1974

[21] Appl. No.: 493,471

Related U.S. Application Data

[62] Division of Ser. No. 366,627, June 4, 1973, Pat. No. 3,842,484.

[52] U.S. Cl. ..... 4/172

[51] Int. Cl.[2] ..... E04H 3/18

[58] Field of Search ..... 61/22, 28; 4/172, 172.11, 4/172.19

[56] References Cited

UNITED STATES PATENTS 3,582,999 6/1971 Baker ..... 4/172.11

*Primary Examiner*—Robert I. Smith

*Attorney, Agent, or Firm*—Seed, Berry, Vernon & Baynham

[57] ABSTRACT

A hollow fiberglass bulkhead is constructed for submersion in a swimming pool. Two boxes open-top and open-ended are joined, a shelf is added, end supporting hardware is added, a bottom is placed on the box and the ends are closed and the box is then inverted to be installed in the swimming pool. Balsa wood plates provide rigidity and partial flotation while two end rollers prevent the bulkhead from becoming twisted as it is moved along the pool.

4 Claims, 10 Drawing Figures

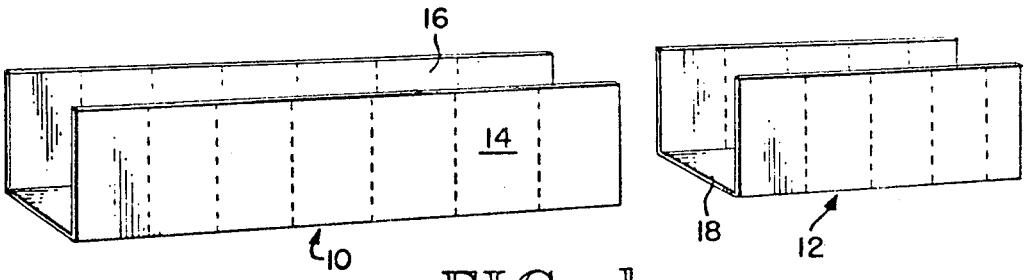
FIG. 1
FIG. 2
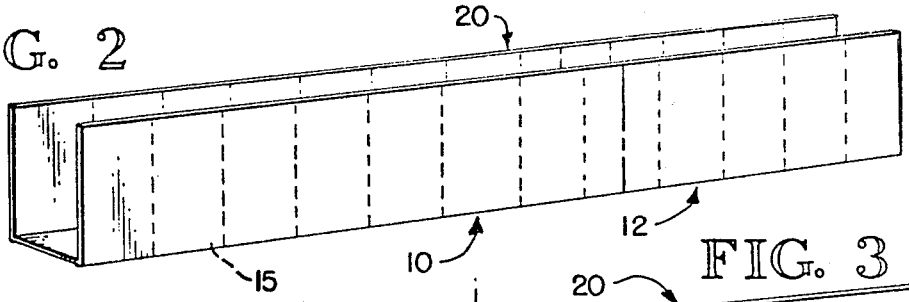
FIG. 3
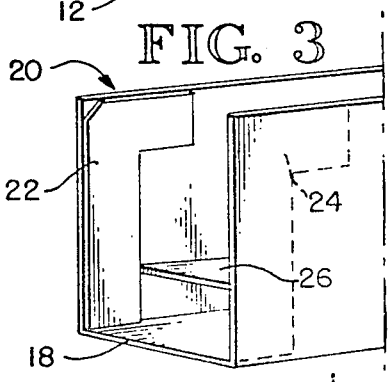
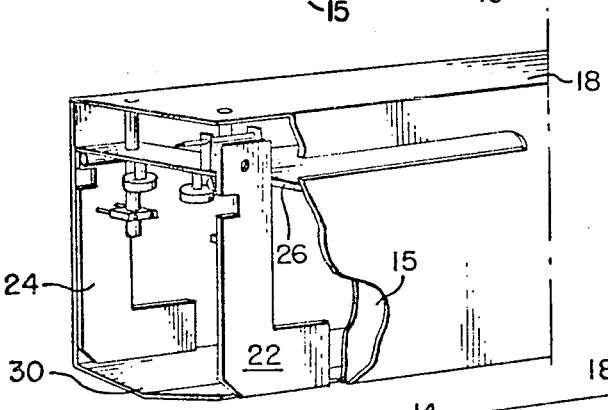
FIG. 4
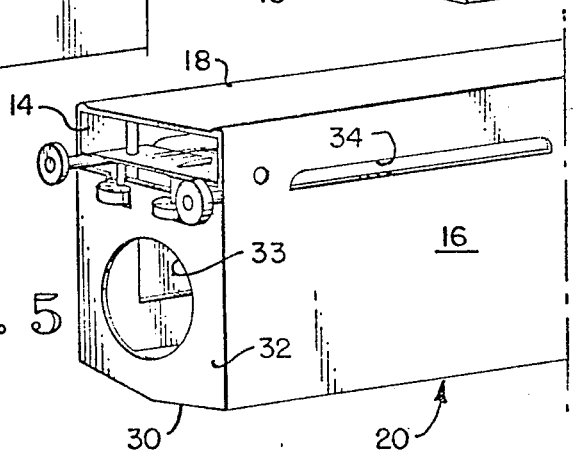
FIG. 5
FIG. 6
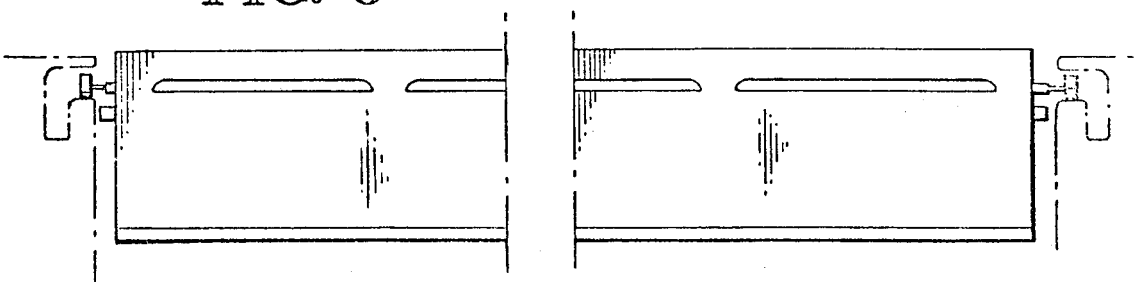

MOVABLE SWIMMING POOL BULKHEAD

This is a Divisional Application of Ser. No. 366,627, filed June 4, 1973, now U.S. Pat. No. 3,842,484.

BACKGROUND OF THE INVENTION

1. Field of the Invention

This invention pertains to methods of constructing movable swimming pool bulkheads and to a fiberglass bulkhead.

2. Description of the Prior Art

Movable bulkheads for swimming pools have heretofore been constructed either of aluminum or fiberglass and resin. Aluminum bulkheads are difficult and expensive to manufacture and costly to repair. Fiberglass bulkheads are less expensive and easier to maintain, however, they are quite heavy and are therefor difficult to handle both in and out of the swimming pool. In addition fiberglass bulkheads are difficult to construct due to their size and enormous weight.

SUMMARY OF THE INVENTION

It is an object of this invention to provide a method for constructing movable bulkheads for swimming pools which is relatively inexpensive and easy to perform.

It is an object of this invention to provide a fiberglass movable bulkhead for a swimming pool which is not extremely heavy when submerged in the pool and yet has high strength and rigidity.

It is another object of this invention to provide a movable bulkhead for a swimming pool which cannot be twisted out of alignment when being moved along the sidewalls of the pool.

BRIEF DESCRIPTION OF THE DRAWINGS

FIGS. 1–6 illustrate steps of the method in constructing a bulkhead in accordance with the teachings of this method.

FIG. 1 illustrates the initial step in the method, FIG. 6 indicates a completion step in which the bulkhead is installed in the swimming pool with the remaining figures showing intermediate steps.

DETAILED DESCRIPTION OF THE PREFERRED EMBODIMENTS

Figure 7:
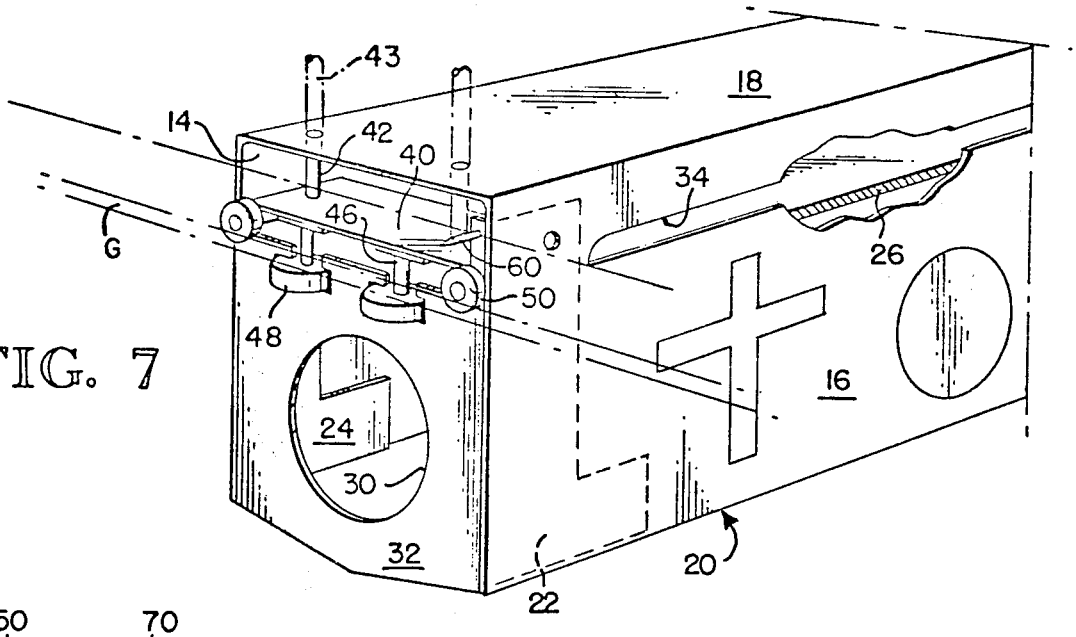
FIG. 7 illustrates a preferred form of bulkhead construction.

The method of constructing the bulkhead is best illustrated in FIGS. 1–6. In the first step a pair of open-ended open-top boxes 10 and 12 having sidewalls 14 and 16 are formed of fiberglass and resin in a mold using generally conventional techniques with the exception that the sidewalls have a ½ inch thick core of abutting 2 × 4 ft. balsa wood sheets 15. A horizontal bottom wall 18 joins the sidewall and as will be explained in more detail below, will eventually become the top wall of the bulkhead. Next, as shown in FIG. 2, the two boxes or bodies 10 and 12 are joined to form a single unitary box 20. FIG. 3 illustrates the next step. While still inverted end plates 22 and 24 are added to each end of the box 20 for supporting hardware which will eventually support the bulkhead in the swimming pool and a shelf 26 is added a short distance up from the bottom 18. Next, a top wall 30 (becomes bottom wall) is added to the box 20 and the box is inverted as in FIG. 4. FIG. 5 illustrates the step of adding the end walls 32. The end walls are each provided with a water access opening 33 which allows water to freely flow into the box as it is being submerged. Wave dampening slots 34 are provided in the side walls 16 and 14 above the shelf 26 to reduce wave impact on the box and to reduce the amount of wave action in the pool. Finally, as best shown in FIG. 5, the supporting hardware is placed on the gutter of the pool or as in the modified embodiment shown in FIG. 8 on the deck of the pool.

Figure 8:
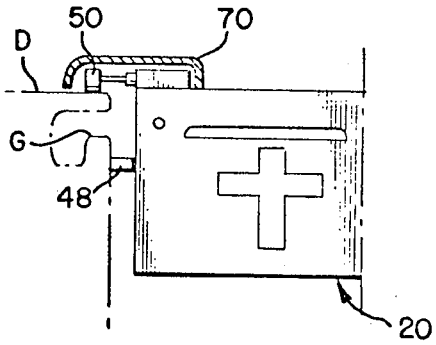
FIG. 8 is a fragmentary front elevation showing a modified installation technique.
Figure 9:
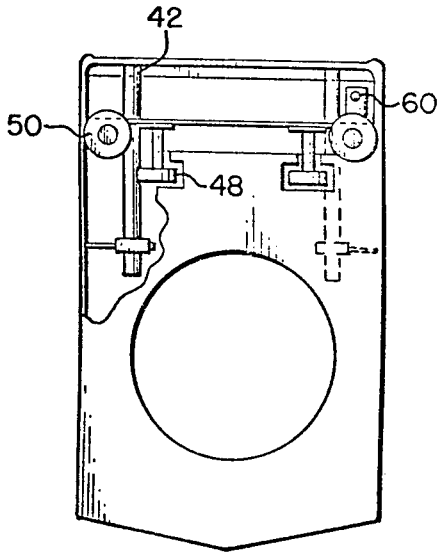
FIG. 9 is an end elevation of the bulkhead shown in FIG. 6.
Figure 10:
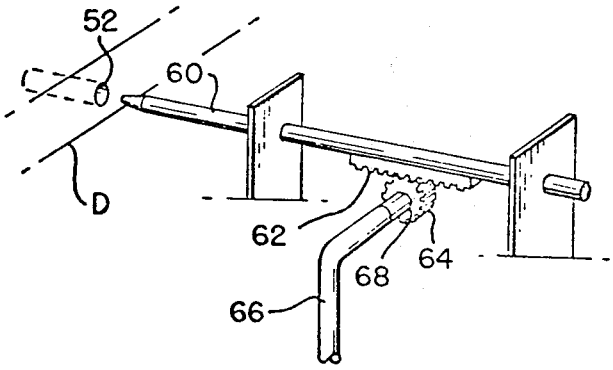
FIG. 10 is a fragmentary view showing means for locking the bulkhead in the swimming pool.

The box itself when fully constructed is best shown in FIGS. 7 and 9. The hardware supporting plates 22 and 24 are molded integrally with and bolted to the sidewalls of the box. Joined to the plates is a horizontal plate 40 which rigidly supports two pipes 42. Pipes 42 provide sockets for the insertion of a removable handle 43 to move the bulkhead along the side of the pool. Rigidly secured on the bottom of plate 40 is a pair of shafts 46 which rotatably mount side rollers 48. As is readily apparent these are two guide rollers laterally spaced from one another such that adequate support is applied on both sides of the center plane of the box so that when the box is moved along the side walls of the swimming pool it will not twist and bind. Also rotatably mounted on the plate 40 is a pair of laterally spaced rollers 50 which rotate about horizontal axes and support the box either in the gutter G of the swimming pool or on the deck D as shown in the modification FIG. 8.

An anchor pin 60 is joined to a rack 62 that is reciprocated by a gear 64. The gear is powered manually by a key or handle 66 that fits in a square opening 68 in the gear. Suitable sockets are provided in the sidewall of the swimming pool so that by rotation of the handle 66 the pin 60 can be moved into a socket and lock the bulkhead against movement in the pool.

In the modification shown in FIG. 8 the rollers 50 are rotatably mounted from the top of the box and are covered by a cowling 70. This type of arrangement is preferred where the size of the gutter is not standard and too small for use of the rollers 50.

Part of the weight of the box is carried by the buoyancy of the water in the pool. This buoyancy is supplemented by the addition of the continuous balsa wood plates 15 dispersed throughout the fiberglass box. The balsa wood also provides rigidity, thus strengthening the box while reducing the overall weight of the box.

While the preferred forms of the method and apparatus have been described and illustrated, variations will be readily apparent to one skilled in the art without departing from the principles of the invention. Accordingly the invention is not to be limited to the embodiments described.

I claim:

1. A movable, submersible bulkhead for a swimming pool, comprising:

an elongated hollow body having top, bottom, end and side walls formed of fiberglass and resin, and a platform between the top and bottom walls and joining the side walls, openings in said end walls for providing ingress of water into the body, slots in the side walls at the water level for dampening wave action of the water, said side walls of said body including cores of balsa wood for rigidifying the body and providing partial flotation, and means for supporting and aligning the body within the pool including a pair of transversely spaced rollers on each end of the body for engaging the pool for carrying the weight of the body and preventing rotation of said body when the same is moved laterally along the pool.

2. The bulkhead of claim 1, wherein said balsa wood cores comprise plates abutting one another and extending substantially the entire length of said side walls.

3. The bulkhead of claim 1, wherein said body supporting and aligning means includes transversely spaced rollers each having a horizontal axis, said body supporting and aligning means also including a second set of transversely spaced rollers on each end of said body and being rotatable about vertical axes and engagable with the pool side walls.

4. The bulkhead of claim 3, wherein said balsa wood cores comprise a plurality of abutting plates extending substantially the entire length of each body side wall.

* * * * *